United States Patent [19]

Orii

[11] Patent Number: 4,498,840

[45] Date of Patent: Feb. 12, 1985

[54] REVERSING APPARATUS

[75] Inventor: Masaru Orii, Machida, Japan

[73] Assignee: Kabushiki Kaisha Orii Judoki Seisakusho, Japan

[21] Appl. No.: 581,214

[22] Filed: Feb. 22, 1984

Related U.S. Application Data

[63] Continuation of Ser. No. 292,215, Aug. 12, 1981, abandoned.

[30] Foreign Application Priority Data

May 15, 1981 [JP] Japan ..... 56-72220

[51] Int. Cl.[3] ..... B65G 47/24

[52] U.S. Cl. ..... 414/759; 414/774

[58] Field of Search ..... 414/758, 759, 763, 774

[56] References Cited

U.S. PATENT DOCUMENTS

| | | | |
|---|---|---|---|
| 3,487,953 | 1/1970 | Wolf | 414/759 |
| 3,552,582 | 1/1971 | Hanft | 414/759 X |
| 3,967,723 | 7/1976 | Beckham | 414/759 X |
| 4,050,574 | 6/1976 | Chenevard et al. | 414/763 X |

FOREIGN PATENT DOCUMENTS

| | | | |
|---|---|---|---|
| 102755 | 8/1979 | Japan | 414/759 |

*Primary Examiner*—Leslie J. Paperner
*Assistant Examiner*—Ken Muncy
*Attorney, Agent, or Firm*—Kane, Dalsimer, Kane, Sullivan and Kurucz

[57] ABSTRACT

This disclosure pertains to an apparatus for turning a workpiece upside down. The apparatus is constructed of first and second arms supported on a base, the first arm comprising a lower section that is pivotably connected to the base, an upper section that can be pivoted from a horizontal position to a downwardly inclined position, and a central section that is elongated from the lower section to the upper section, a first workpiece supporter that is pivotably connected to the upper section of the first arm;

a first lever to pivotably actuate the first workpiece supporting; a second lever means to pivotably actuate the first arm;

the second arm comprising a lower section that is supported on the base, an upper section that can be pivoted from a horizontal position to a downwardly inclined position; a third lever to pivotably actuate a moving member mounted on the upper section of the second arm; and a second workpiece supporter positioned on the moving member; whereby the workpiece held on the upper section of the first workpiece supporter is transferred to the upper section of the second arm below the work plane while being turned upside down.

1 Claim, 8 Drawing Figures

REVERSING APPARATUS

This is a continuation of application Ser. No. 292,215, filed Aug. 12, 1981, now abandoned.

FIELD OF THE INVENTION

This invention relates to an apparatus which is installed in the working line for turning the workpiece upside down.

BACKGROUND OF THE INVENTION

The conventional reversing apparatus uses a flat member which receives a workpiece in one horizonal position and is rotated about a horizontal axis by 180° to transfer the workpiece over the axis to the adjacent flat member in another horizontal position. When the workpiece grabbed by vacuum suction cups is rested on the receiving member in one horizontal position, it is rotated by 180° to another horizontal position and the reversed workpiece is transferred to the working line in said new horizontal position. According to this reversal system, the vacuum suction cups must be lifted high and retracted to be outside the area of rotation of the receiving member when it is making a 180° turn, so the period of retracting the cups is included within the period of reversing the workpiece. This means a prolonged and hence, inefficient reversing operation. Furthermore, raising the cups high requires the use of a tall reversing apparatus and a long and complex piping system connected to the cups.

SUMMARY OF THE INVENTION

Therefore, one object of this invention is to provide a reversing apparatus capable of reversing a workpiece in a short period of time.

Another object of this invention is to provide a reversing apparatus which does not require a large installation space and requires only a short and simple piping system for the vacuum suction cups.

PREFERRED EMBODIMENT OF THE INVENTION

One preferred embodiment of this invention is now described by reference to the accompanying drawings, wherein.

Figure 1:
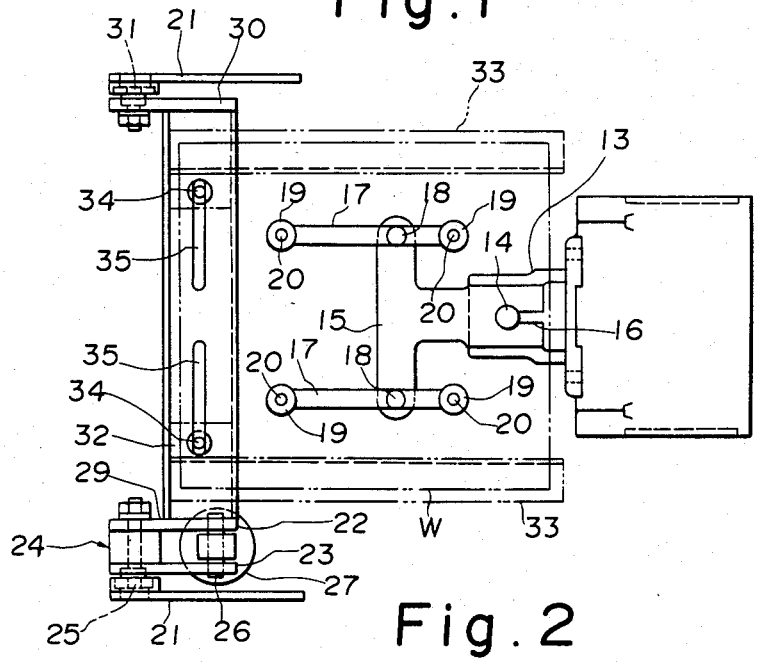
FIG. 1 is a plan view of a reversing apparatus according to this preferred embodiment.

FIGS. 3 to 8 schematically represent the sequence of the operation of the reversing apparatus of FIG. 1.

In FIG. 1, the base table of the reversing apparatus according to this invention is generally indicated by the numeral 1. A pair of brackets 2, 2 on the right-hand section of the base table are pivotally connected to clamping arms 4, 4 by pins 3, 3. Each clamping arm, 4 is generally L-shaped and the end of the piston rod (that is, first lever) of a first hydraulic cylinder (that is, means to actuate said first lever) 6 (hereunder referred to as the first cylinder) is connected slightly down below the central part of the clamping arm 4 by a pin 5. The first cylinder 6 is connected to the base table 1 by a pin 7. A crank member 9 is pivotally connected to the top of each arm member 4 by a pin 8, and the operating end 9*a* of the crank member is connected to the end of the piston rod (that is, a second lever) of a second hydraulic cylinder (that is, means to actuate the second lever) 10 (hereunder referred to as the second cylinder) by a connecting member 11. Each of the second cylinders 10 is connected below the center of the clamping arm 4 so that it is substantially aligned with the longitudinal direction of the central part of the clamping arm 4. A vacuum holder fixing member 13 is fixed between the operating ends 9*b* of the crank members 9, 9 by bolts 12. A T-shape vacuum holder 15 is attached to the top of the fixing member 13 by a bolt 14. The bolt 14 is screwed into the fixing member 13 through a long slot 16, and by moving the bolt within the length of the slot 16, the location of the vacuum holder 15 can be adjusted in the horizontal direction in FIG. 1. A plurality of elongated cup supporting members (two such members are shown in FIG. 1) are installed by bolts 18, 18 on both ends of an elongated portion that forms the foremost end of the vacuum holder 15. The bolts 18 are screwed into the vacuum holder 15 through long slots (not shown) formed in the cup supporting members 17 in their longitudinal direction, and by moving the bolts within the slots lengthwise, the location of the cup supporting members 17 can be adjusted in the horizontal direction in FIG. 1. The cup supporting members 17 are pivotable about the bolts 18 and can be installed in a suitable pivoting position. A bowl-shaped cup 19 made of rubber, synthetic resin, etc. and having an open top is mounted on the top of both ends of each cup supporting member 17, and these cups are positioned on the same plane as that formed by similar cups 19 mounted on the top of both ends of the other cup supporting member 17. A workpiece supporting arm is constituted of fixing member 13, bolt 14, vacuum holder 15, cup supporting member 17, bolt 18 and bowl-shaped cup 19. And the underside of hole 20 in the center of each cup 19 is connected by a pipe to a vacuum means (not shown). The underside of a hole 20 in the center of each cup 19 is connected by a pipe to a vacuum means (not shown). The above named components make up a first arm A on the right side of the base table 1 wherein the clamping arms 4 are positioned at the lower part and the cup supporting members 17 are positioned at the upper part of the system.

A pair of frames 21, 21 are fixed upright to the left-hand section of the base table 1. A U-shaped pivotally moving member 24 formed by integral combination of a pair of elements 22, 23 is connected to the upper end of one of the frames 21 by a bolt 25. A pin 26 is provided between the foremost ends of the elements 22, 23, and the pin 26 is connected to the end of the piston rod (that is, a third lever) of a third hydraulic cylinder (that is, means to actuate the third lever) 27 (hereunder referred to as the third cylinder) by a connecting member 28. The third cylinder 27 is connected to the part of said one of the frames 21 which is somewhat down below its center so that the cylinder 27 is substantially in an upright position. A supporting member 29 is fixed to the element 22, and a similar supporting member 30 is pivotally connected to the other frame 21 by a bolt 31. A guide member 32 whose cross section is similar to that of a crank is provided between the supporting members 29, 30, and two receiving members (that is, workpiece supporting arms) 33 having a slidable element 33*a* at one end are attached to the upper surface of the guide member 32 by bolts 34. Each bolt 34 is attached to the slidable element 33*a* as it is guided by a long slot 35 in the guide member 32, and by moving the bolt along the length of the slot 35, the location of each receiving member 33 can be adjusted in the vertical direction in FIG. 1. On the upper surface of each receiving member 33, there are projections (not shown) that engage predetermined portions, say, holes, in the surface of the workpiece W to be reversed. The above identified components make up a second arm B on the left side of the base table 1 wherein the fixed frames 21 are positioned at the lower part and the receiving members 33 are positioned at the upper part of the system.

Figure 2:
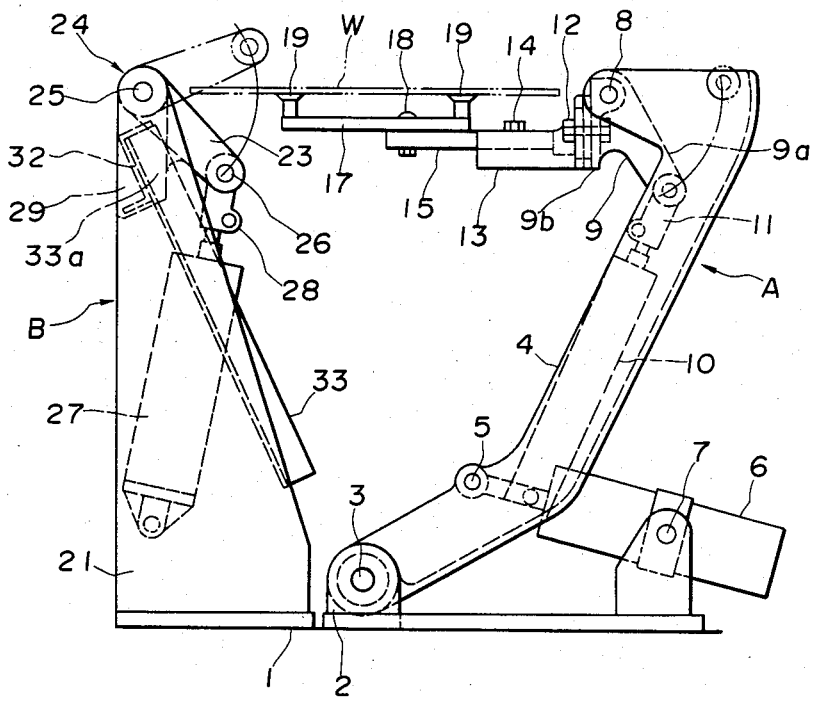
FIG. 2 is a front view of FIG. 1.

The reversing apparatus of this invention having the above described arrangement is installed on the working line and is so positioned that the workpiece W to be reversed is rested on the cups 19 when the cup supporting members 17 are in a horizontal position as indicated in FIG. 2.

Figure 3:
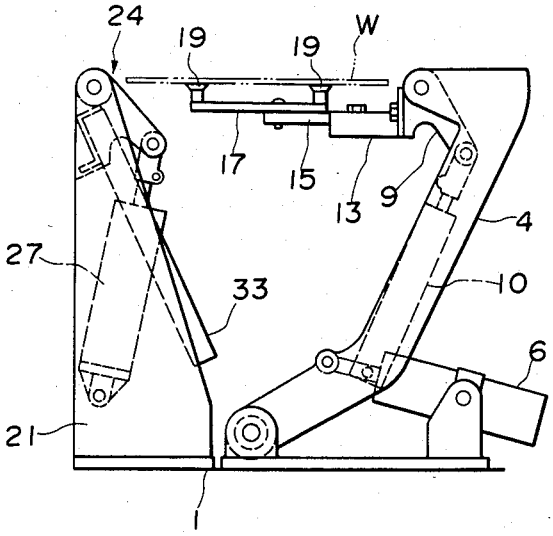
Figure 4:
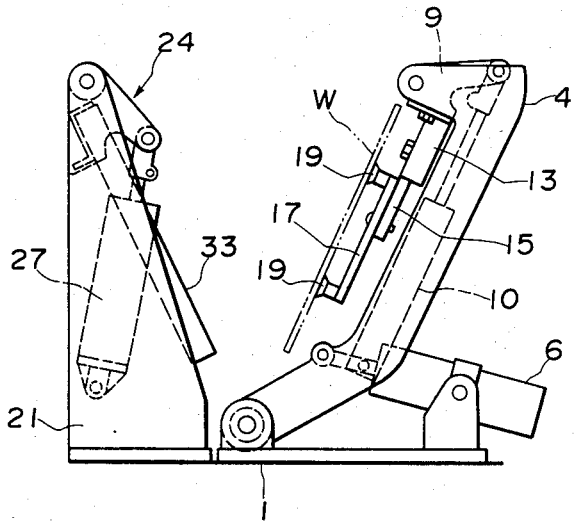
Figure 5:
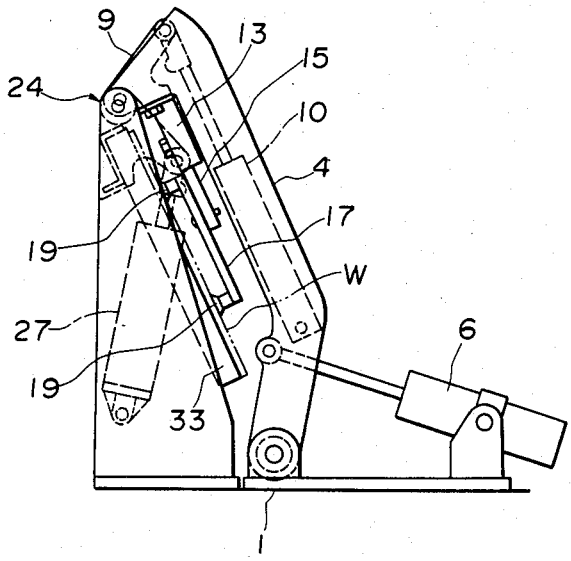
Figure 6:
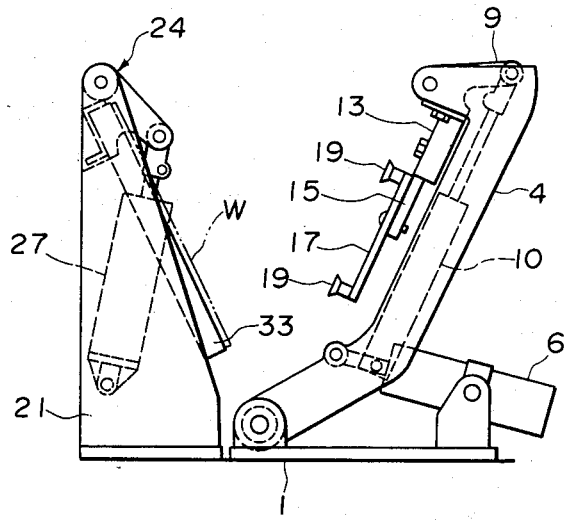
Figure 7:
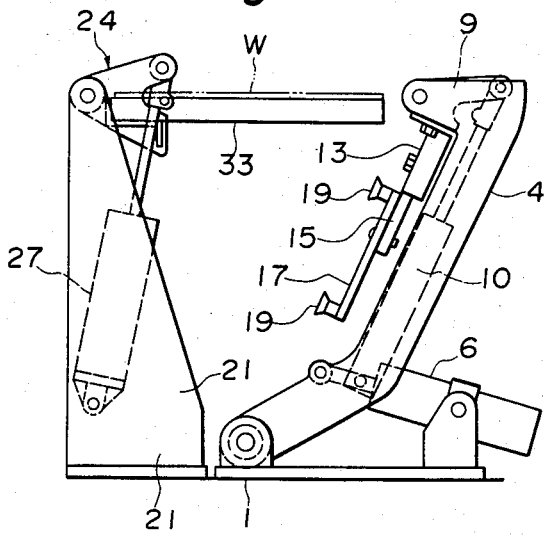

The sequence of operation of the reversing apparatus according to this invention is now described by reference to FIGS. 3 to 8. FIG. 3 shows the apparatus in a stand-by position. The piston rods of the cylinders 6, 10 and 27 are in a retracted position; the clamping arms 4 are in the farthest position of clockwise pivoting, the crank members 9 are in the farthest position of counterclockwise pivoting for bringing the cup supporting members 17 to a horizontal position; and the pivoting member 24 is in the farthest position of clockwise pivoting for making the receiving member 33 inclined downward. If the workpiece W to be reversed is rested on the cups 19 as shown by the one long and two short dashed line in FIG. 3, a vacuum means (not shown) sucks air to securely hold the underside of the workpiece W by the cups 19. Thereafter, the piston rod of the second cylinder 10 is extended as shown in FIG. 4, and the crank members 9 are pivoted to the farthest position of clockwise pivoting for making the cup supporting members 17 inclined downward. Throughout this pivoting motion, the workpiece W remains sucked to the cups 19. Subsequently, the first cylinder 6 is extended as shown in FIG. 5, the arms 4 are pivoted to the farthest end of counterclockwise pivoting to bring the obverse side of the workpiece W into face-to face relationship with the receiving members 33. Then, the projections (not shown) on the receiving members 33 come into engagement with the holes in the obverse side of the workpiece W. After the engagement is completed, the creation of vacuum to hold the workpiece W on the cups 19 is terminated. Then, as shown in FIG. 6, the piston rod of the first cylinder 1 is retracted and the arms 4 are pivoted clockwise to return to the farthest end of pivoting. Consequently, the workpiece W is transferred to the receiving members 33 and securely held by the projections on said members. In the next step, the piston rod of the third cylinder 27 is extended and the pivoting member 24 is pivoted clockwise to the farthest end of pivoting until the receiving members 33 become level. As a result, the workpiece W is now in the position where it was initially rested on the cups 19 but it has been turned upside down.

Figure 8:
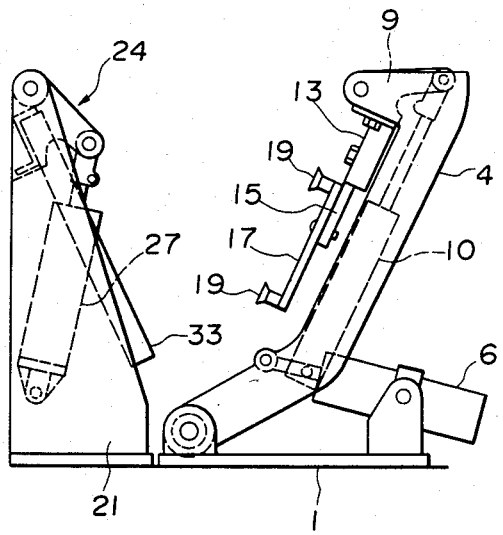

After the reversed workpiece W is sent to the subsequent working line, the piston rod of the third cylinder 27 is retracted again as shown in FIG. 8, so are the piston rods of the first and second cylinders 6 and 10, and, in consequence, the reversing apparatus of this invention is returned to a stand-by position as shown in FIG. 3. By repeating the above cycle automatically, the reversal of the workpiece W can be performed continuously. It is to be noted that the construction of the mechanism installed in the upper portion of the first and second arms A and B to hold the workpiece W in position, or that of the means to actuate the two arms is by no means limited to the illustrated embodiment, and various design alterations are possible depending upon the type of workpiece.

As described in the foregoing, the reversal apparatus according to this invention achieves smooth reversal of the workpiece by the cooperation of the first and second arms, so the workpiece can be turned upside down efficiently in a short period of time. Furthermore, the apparatus may be installed below the working line, so only a short piping system is necesssary for connection to vacuum means and a fairly small installation space is required for the apparatus.

What is claimed is:

1. A reversing apparatus for turning a workpiece upside down including:

a. a base;

b. a first arm comprising:

1. a pair of L-shaped members each having a lower end pivotably connected to said base, and an upper end;
2. a first cylinder attached to said base, with a piston rod, an end of the piston rod being pivotably connected to said lower ends of said pair of L-shaped members and capable of pivoting said first arm from a first to a second position with respect to said base;
3. a pair of crank members being pivotably connected by connecting means to the upper ends of said pair of L-shaped members each having an operating end extending past said connecting means;
4. a second cylinder being connected to the lower ends of said pair of L-shaped members, and being coextensive with the upper ends of the pair of L-shaped members, and having a piston rod with a piston rod end being pivotably connected to said operating ends of said pair of crank members, said second cylinder being provided to pivot said crank members from a horizontal to an inclined position; and
5. a workpiece supporting member attached to said crank members and comprising:
   A. a holding member attached to said crank members;
   B. a T-shaped member attached to said holding member with two lateral extensions;
   C. a plurality of vacuum support members attached to said lateral extensions; and
   D. a plurality of bowl-shaped cups attached to said vacuum support members and adapted to hold a work piece when vacuum is applied to said cups; and c. a second arm comprising:

(1) a first and second frame fixed upright to said base adjacent to said first arm, each having a lower frame end and an upper frame end;
(2) a pivoting member connected to the upper frame end of said first frame;
(3) a work-piece support member extending between said frames and being affixed to said pivoting member at one side and being pivotably affixed at another side to the second frame; and
(4) a third cylinder being connected to the lower frame end and having a piston rod with an end connected to said pivoting member and provided to pivot said work-piece support member between an inclined and a horizontal position;

said first arm being constructed and arranged to move a workpiece disposed on said workpiece supporting member from a horizontal position to an intermediate position by pivoting said crank members to said inclined position and then pivoting said first arm from said first to said second position, said workpiece in said intermediate position being oriented passed its vertical dead center; and said second arm being constructed and arranged to receive said workpiece from said first arm when said first arm is in said intermediate position.

* * * * *